US010131460B2

(12) United States Patent
Koolhaas

(10) Patent No.: US 10,131,460 B2
(45) Date of Patent: Nov. 20, 2018

(54) CONTAINER SLEEVING METHOD AND SYSTEM FOR FIXING A SLEEVE AROUND A CONTAINER

(71) Applicant: FUJI SEAL INTERNATIONAL, INC., Osaka-shi, Osaka (JP)

(72) Inventor: Ernst Christiaan Koolhaas, Nuenen (NL)

(73) Assignee: FUJI SEAL INTERNATIONAL, INC., Osaka-shi (JP)

( * ) Notice: Subject to any disclaimer, the term of this patent is extended or adjusted under 35 U.S.C. 154(b) by 935 days.

(21) Appl. No.: 14/405,984

(22) PCT Filed: Jul. 2, 2013

(86) PCT No.: PCT/EP2013/063914
§ 371 (c)(1),
(2) Date: Dec. 5, 2014

(87) PCT Pub. No.: WO2014/006033
PCT Pub. Date: Jan. 9, 2014

(65) Prior Publication Data

US 2015/0121806 A1 May 7, 2015

(30) Foreign Application Priority Data

Jul. 2, 2012 (NL) ..... 2009104
Feb. 7, 2013 (NL) ..... 2010272

(51) Int. Cl.
*B65C 3/06* (2006.01)
*B65B 11/00* (2006.01)

(52) U.S. Cl.
CPC ..... *B65C 3/065* (2013.01); *B65B 11/00* (2013.01)

(58) Field of Classification Search
CPC .. B65C 3/065; B65C 3/06; B65C 3/08; B65C 3/14; B29C 63/42; B29C 63/423;
(Continued)

(56) References Cited

U.S. PATENT DOCUMENTS 3,767,496 A * 10/1973 Amberg ..... B29C 53/42 156/84
4,011,122 A * 3/1977 Ashcroft ..... B29C 63/426 156/294
(Continued)

FOREIGN PATENT DOCUMENTS

EP 1016595 A1 7/2000
JP 2007112465 A 5/2007
(Continued)

OTHER PUBLICATIONS

Oct. 28, 2013 International Search Report issued in International Application No. PCT/EP2013/063914.
(Continued)

*Primary Examiner* — Thanh Truong
*Assistant Examiner* — THomas Wittenschlaeger
(74) *Attorney, Agent, or Firm* — Oliff PLC

(57) ABSTRACT

The invention relates to container sleeving system and method. Sleeves of heat shrinkable foil are arranged around the container. The sleeves are supplied by ejecting the sleeve from the sleeve supply. Containers are supplied form a container supply. The sleeve supply arranges the sleeve around the container by moving the sleeve upwardly around the container. A heat shrink oven is arranged for fixing the sleeve to the container. A conveyor transports containers.

21 Claims, 9 Drawing Sheets

Figure 1:
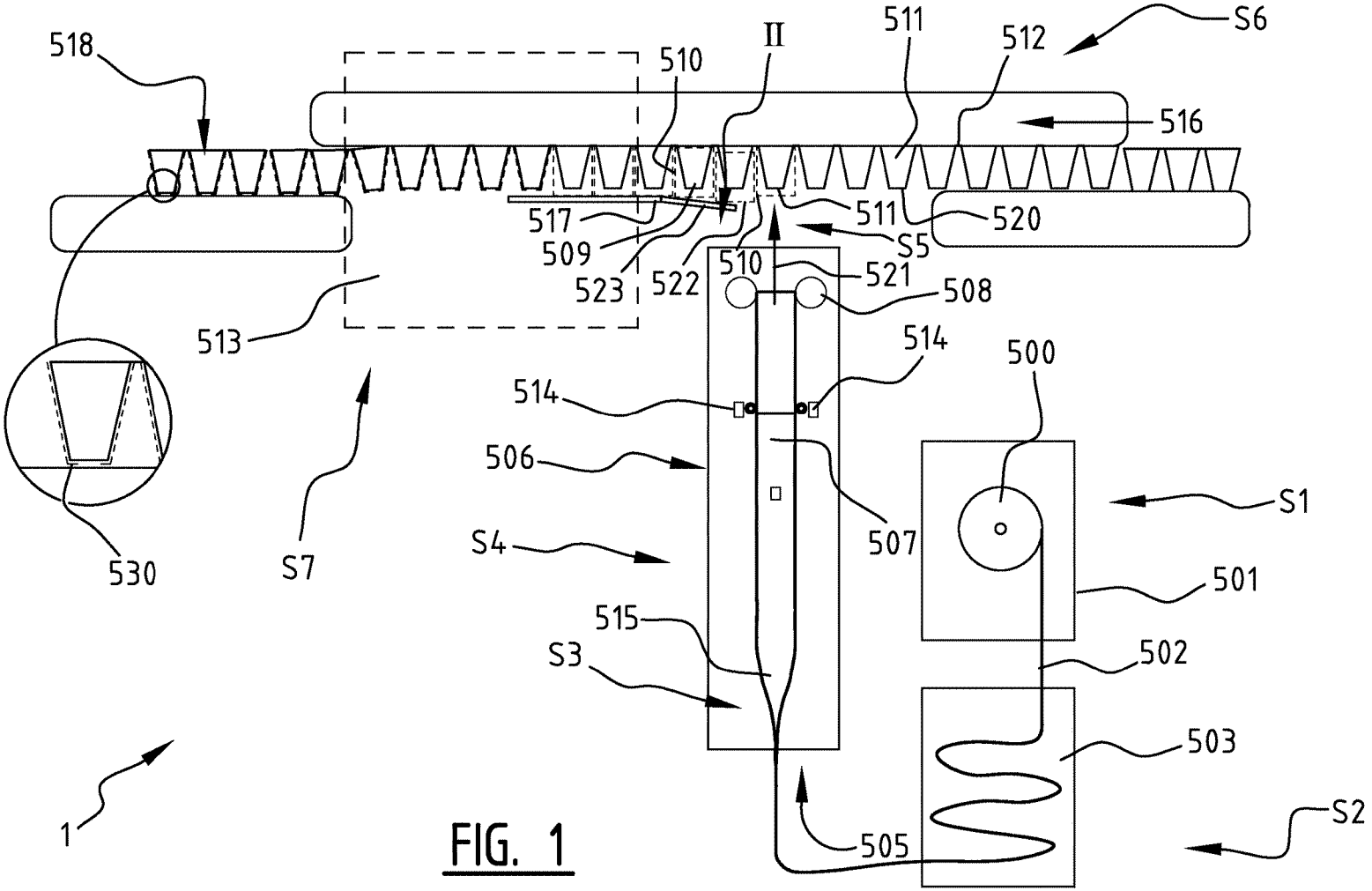

(58) Field of Classification Search
CPC ..... B29C 63/18; B29C 63/426; B29C 51/165; B29C 31/002; B65B 11/00
USPC ..... 53/399, 442, 452, 459, 557, 563, 567, 53/582, 585
See application file for complete search history.

(56) References Cited

U.S. PATENT DOCUMENTS 4,048,281 A * 9/1977 Brummett ..... B29C 63/423 156/497
4,199,851 A * 4/1980 Doherty ..... B23P 11/025 156/218
4,302,275 A * 11/1981 Burmeister ..... B29C 31/002 156/218
4,325,762 A * 4/1982 Burmeister ..... B29C 63/423 156/272.2
8,082,967 B2 * 12/2011 Zacche ..... B65C 3/065 156/443
8,293,047 B2 * 10/2012 Minganti ..... B65C 3/065 156/497
2012/0085497 A1 * 4/2012 Minganti ..... B65C 3/065 156/423

FOREIGN PATENT DOCUMENTS

WO 2004067385 A1 8/2004
WO 2005082601 A1 9/2005
WO 2009000668 A2 12/2008
WO 2011031160 A1 3/2011

OTHER PUBLICATIONS

Oct. 28, 2013 Written Opinion issed in International Application No. PCT/EP2013/063914.
Jul. 8, 2014 International Preliminary Report on Patentability issued in International Application No. PCT/EP2013/063914.

* cited by examiner

CONTAINER SLEEVING METHOD AND SYSTEM FOR FIXING A SLEEVE AROUND A CONTAINER

The invention relates to a container sleeving method for arranging a sleeve around a container. The invention also relates to a container sleeving system for arranging sleeves around containers.

Heat shrinkable sleeves can be used to provide labels on containers for e.g. identifying the content of the container.

From EP 1 587 736 A1 it is known to arrange sleeves around containers having a rim by prearranging several sleeves in an open position. Retractable pins are used for holding the sleeve in an upright position. A container suspended on cables can be positioned in the opened sleeve. Subsequently the sleeve is fixed to the container using heat. The known method is not suited for high speed labelling.

EP 1 016 595 discloses preformed conical sleeves. The sleeves are formed having a permanent opened position. A container is positioned in the sleeves.

A problem associated with the known method is to increase the speed and in another embodiment to increase the reliability of the sleeving method. It is a goal of the present invention to improve the known method.

U.S. Pat. No. 4,048,281 discloses a machine wherein bottles loaded on neck gripping chucks connected to an endless driven carriage are transported along a number of mandrels positioned beneath the bottles. The chucks have their centres in registry with the vertical central axes of the underlying mandrels. Each mandrel is provided with an annular, encircling push-up bar that may be caused to undergo a reciprocating movement. A plastic strip is first wound around the mandrel, then seamed to form a sleeve. The mandrel and chuck then travel together during which the sleeve us pushed upwards by the push-up bar into a position wherein the sleeve is arranged around the bottle so that the sleeves may be attached to the bottles in a heat-shrinking process.

A drawback of the known machine is that is relatively complex and has a relatively low processing speed. Furthermore, by using a push-up bar to move the sleeve over the bottom end of the bottle the known machine is less suitable for handling containers made of relatively flexible material and for using highly flexible sleeving material, for instance relatively thin sleeving material. A further drawback is that the machine is not suitable or less so for sleeving containers of a generally tapering shape (i.e. having a top end that is wider than the bottom end thereof).

A similar construction is disclosed in U.S. Pat. No. 3,767,496 A. This document discloses a bottle sleeving method and device wherein a sleeve is raised and inserted telescopically over the lower end of a bottle by gripping the sleeve and pushing the gripped sleeve upwards using a rod. Since the mechanical means grip the sleeve at the bottom end thereof the sleeve material needs to be relatively thick and inflexible. This makes the known method and device unsuitable or less so for using thin and flexible sleeves and/or may reduce the overall sleeving speed of the sleeving device. The devices disclosed in JP 2007 112465 A and WO 2009/000068 A2 have similar disadvantages.

It is an object of the invention to provide a method and system wherein at least one of the above-identified and/or other disadvantages have been removed or at least reduced.

It is a further object of the invention to provide a method and system that enable a relatively fast and reliable arrangement of sleeves around containers, especially (but not exclusively) in case of tapering containers.

According to a first aspect of the invention an improved container sleeving method for fixing a sleeve around a container is provided.

According to embodiments of the invention the method comprises:

supplying a container;

arranging a sleeve of heat shrinkable foil around the container by releasing the sleeve from a mandrel unit by ejecting the sleeve towards the container;

wherein the ejected sleeve is moved upwardly in substantially the opposite direction of the gravitational force to a position around the container.

By ejecting sleeves towards the containers passing by, or, more specifically, shooting sleeves from the mandrel unit towards the containers and sliding them over the bottom ends of the containers the sleeves can be arranged around the container in a fast and reliable manner. Furthermore the arrangement of a sleeve around a container by ejecting (shooting) the same from a mandrel enables very flexible sleeve material to be used since no use needs to be made of structural means that grab a sleeve and pull the same over the container.

In embodiments of the invention the sleeves are arranged around the container directly from the mandrel unit as a result of the kinetic energy imparted on the sleeve by ejecting the same from the mandrel unit. In the trajectory from the mandrel unit to the container the sleeve is unsupported by any means. The kinetic energy imparted to the sleeve should be sufficient to allow the sleeve to at least partially be guided over de bottom end of the container. In other embodiments an auxiliary guidance may be provided for bringing the ejected sleeve in its position around the container. Direct ejection is however preferred. Accordingly the sleeve is shot around the container in a single operational step.

Ejecting a sleeve from a mandrel unit and moving the sleeve upward over and around the container allows approaching the container with the sleeve from below. In some embodiments sleeving over the top of the container is blocked.

Preferably sleeves of heat shrinkable foil are supplied. Preferably tubular sleeves are supplied. The heat shrinkable sleeves can comprise printed foil and form the labels having for example product information that is to be arranged around the container. The sleeve supply could be connected to a supply of flattened tubular heat shrinkable foil such as a reel with winded foil.

The container may comprise a labelling surface onto which a label is to be fitted. The labelling surface can be conical, tubular, or other forms. The sleeve is arranged around the container and in a subsequent operation, such as heat shrinking, the sleeve may be fixed around the container, creating a labelled container. Sleeving the container is a known high speed, reliable method as part of labelling containers.

The method may comprises continuously conveying an array of containers and arranging sleeves over consecutive containers while the containers are being conveyed. The containers may be handled in a continuous manner thereby increasing the handling speed of the sleeving system.

The method may involve a stationary mandrel unit from which sleeves are ejected while the containers are being conveyed along the mandrel unit. The stationary arrangement of the mandrel unit enables the mandrel unit to be constructed and operated in a simple and reliable manner.

Containers in this application comprise all kinds of elements that can contain fluids, liquids, granulates etc. Containers comprise bottles and bags. Many containers have an opening, e.g. a removable lid near a top side of the container. Other containers have a wide top. In many applications the container is already filled with a liquid or fluid prior to sleeving and labelling. By moving the sleeve over the container upward, it is possible to arrange the sleeve over the container from a bottom side, e.g. if the bottom side of the container is the narrowest (has the smallest maximum circumference). The top side having the opening can be held upright, e.g. preventing the contained fluid/liquid of the container to contact the opening/removable lid.

By vertically upward sleeving the sleeve is ejected/shot up against the gravitational force. In an embodiment the sleeve has a circumference somewhat larger-than the body of the container onto which the sleeve is to be arranged. In an embodiment the ejected sleeve is held around the container by providing glue on the sleeve or on the container.

In an embodiment the method allows a continuous operation of feeding sleeves and containers. In an embodiment a continuous method is provided that allows to continuously feed either sleeves and/or containers for fixing the sleeves. In an embodiment the supplied sleeves and/or supplied containers are conveyed. A method that comprises the continuous conveying of sleeves and/or containers allows operating at higher speeds. Such continuous conveying is an improvement of EP 1 587 736-A1. Conveying can comprise supporting the sleeve/container in an upright position. In an embodiment conveying comprises supporting the container in a hanging arrangement.

According to an embodiment providing a sleeve of heat shrinkable foil comprises providing flattened tubular foil, opening the foil and cutting sleeves from the foil. This automated and continuous method, e.g. known from WO2011-031160 in the name of the same applicant, explicitly included by reference, allows high speed supply of tubular foil and individual sleeves. This will increase the speed at which the labelling method can operate.

In an embodiment providing and supplying the sleeve, by cutting the sleeve from foil, is according to the invention directly followed by bringing the sleeve in the predetermined position in which it will be fixed to the container. This prevents further operational steps for handling the cut sleeve and/or obtaining the predetermined position after supplying the sleeve. The method accordingly is reduced in complexity. This will save costs, not only operational but also for configuration. Further, the reliability is increased and floor space is saved.

In an embodiment the container and sleeve arranged around the container are transported into a heat shrink oven and the sleeve is heat shrunk around the container to fix the sleeve to the container. During the heat shrinking process the containers may be stationary or may continue to be transported through the oven. For heat shrinking preferably steam is used. The container and sleeve are preferably held in an upright position. The longitudinal axis of the sleeve extends in a vertical direction.

Other embodiments for shrinking and fixing the sleeve could include tack guns or small sleeve connection stations. In another embodiment a container could be sprayed wet and the sleeve could stick. Also a static loading connection could be used to fix the sleeve.

In an embodiment steam is applied onto the sleeve from the sides while transporting the sleeve/container through the heat oven. Further heat, specifically steam, can be directed towards the sleeve/container from one or more sides, for instance from the bottom side.

In an embodiment the method comprises transporting, specifically conveying, containers suspended with an end to be sleeved extending downwardly.

In an embodiment a top side of the container is engaged, leaving the bottom end free to be sleeved.

In an embodiment the container are conveyed passing the mandrel and allowing to arrange the sleeve around the conveyed container by ejecting the sleeve upwardly. The combination of container and sleeve conveyed further downstream.

In an embodiment an auxiliary support is provided to upwardly support the ejected sleeve in its position around the container. The support overcomes the gravitational force.

In an embodiment the ejected sleeve is shot around the container. Subsequently the ejected sleeve is guided into a predetermined position with respect to the container. Ejecting the sleeve brings the sleeve in generally defined position around the container, while a more specific guidance is provided to bring the sleeve in its desired position with respect to the container in a subsequent operation.

The method may comprise supporting an ejected sleeve once it has reached the position around the container and/or before the sleeve drops off the container due to gravity. In an embodiment the support may comprise a belt to upwardly supporting the ejected sleeve in its position around the container. The belt can move along with the sleeve arranged around the container while being conveyed.

Supporting the ejected sleeve arranged around the container may comprises displacing the sleeve to a predetermined position with respect to the container, preferably displacing the sleeve upwardly to a suitable position for subsequent attaching the sleeve to the container. For instance, while the sleeved container is conveyed in the direction of the oven, the sleeves may be guided along a stationary or moving element (such as a belt). Moving the element along the element may cause the sleeve to be moved upward or downward to a suitable position wherein the sleeve may be attached to the container.

In an embodiment the belt is moving at the same, but preferably at a higher speed than the sleeve and container being conveyed. As the sleeve is shot upwardly onto the horizontally moving container, the upwardly moving sleeve is imparted a horizontal velocity component as a result of the movement of the container onto which it is arranged. This can cause a part, in particular the downward end of the sleeve, to be lacking behind. By providing a belt that in particular engages the downward end of the sleeve, moving at a higher speed than the transport speed, the sleeve's skewed position can be corrected.

According to embodiments of the invention the step of supporting the ejected sleeve in its position around the container comprises moving a belt beneath the sleeve arranged around the container while being conveyed, the belt being arranged so as to tilt the sleeve to a suitable position. This tilting may be achieved by moving the belt at a higher speed than the container being conveyed and/or by arranging the belt in a oblique position. In some embodiments the belt causes the ejected sleeve to move to a forwardly tilted oblique position for creating space between the sleeve and a next container. The space may be needed to allow the next sleeve to be shot around the next container even when the space between the containers is limited and/or the conveyor speed is high.

In an embodiment guiding the sleeve towards a desired position with respect to the container, and eventually supporting the sleeve in a position around the sleeve, is maintained until after transporting the container with sleeve into the heat shrink oven. The predetermined position is maintained until the heat shrinking starts. The assembly of container and supported sleeve in the predetermined position are transported into the heat oven for heat shrinking and fixing the sleeve around the container.

In an embodiment the method further comprises deep drawing or thermoforming packaging containers, such as cups or the like, on a packaging material strip in at least one longitudinal row. The containers will have a rim. The rim of the container can be used to hold the position of the container.

In a further aspect the invention provides an improved container sleeving system for arranging a sleeve around a container. Heat shrinkable sleeves can be used. Sleeves are supplied and containers are supplied. Sleeves and containers are transported into a heat oven for fixing the sleeve around the container.

According to embodiments of the invention the system may comprise:

a conveyor for transporting containers, and a sleeve supply for arranging heat shrinkable sleeves around containers transported by the conveyor, the sleeve supply comprising a mandrel unit and the mandrel unit comprising an ejection unit for ejecting the sleeve from the mandrel unit, wherein the ejection unit is configured to move the sleeve upwardly in substantially the opposite direction of the gravitational force to a position around the container.

In an embodiment of the invention the ejecting unit is configured to shoot the sleeve from the mandrel unit towards the container causing the sleeve to slide over the container to the position wherein the sleeve is arranged around the container. The arrangement of the sleeve around the container may be done directly from the mandrel unit as a result of the kinetic energy imparted on the sleeve by the ejection unit.

According to an embodiment the container sleeving system comprises a sleeve supply for supplying sleeves made of heat shrinkable foil. The sleeves are preferably tubular. The sleeve supply can be connected to a supply of flattened tubular heat shrinkable foil such as a reel with winded foil. The sleeve supply comprises a mandrel over which the sleeve is transported.

In an embodiment the sleeve supply could comprise an opening unit for opening the tubular foil, a cutting unit for cutting sleeves from the opened tubular foil and an ejection unit for ejecting the sleeve from the sleeve supply. The sleeve supply allows providing individually cut sleeves to be arranged around containers. In an embodiment sleeves are cut from the flattened tubular foil and are ejected and subsequently opened by positioning the sleeve in the predetermined position.

The container sleeving system also comprises a conveyor for transporting containers to continuously supply containers. The supplied containers can be individual containers or can be products comprising multiple containers. The container can already contain a product such as drink or fluid or diary product or nuts or candy. Containers are arranged to hold a portion and can have a lid for opening the container and allowing access to the content of the container. An embodiment comprises a removable seal for opening the container. The container can have a circumference and can have different cross section, such as circular, elliptical, square or rectangular, and can extend in a tubular or conical manner. The container can also have grips or indentations.

In an embodiment the sleeve supply can arrange the sleeve around a container. In an embodiment the sleeve supply comprises an ejection unit for shooting a sleeve from the mandrel around the container.

According to an embodiment of the invention the ejection unit is configured to arrange the sleeve upwardly around the container. Contrary to known methods the sleeve is shot over the bottom or lower part of the container instead of over the top part of the container. This allows orienting the container with the opening as a top part of the container during sleeving. This is specifically advantageous when the container is already filled during sleeving. Furthermore, especially the weakest part of the product "the seal" is handled without speed differences. This results in minimum seal damage risk.

Upside down product position means that the product flow control is made when the seals are in contact with the conveyor belt system. Damage risk happens when products are stopped and conveyor is still in motion. Friction between belt and product seal may damage the seal.

In an embodiment the container sleeving system is a labelling system also comprising a heat shrink oven for fixing the sleeve to the container. The oven for heat shrinking is in an embodiment a steam oven comprising multiple nozzles and several stages for fixing the sleeve to the container.

In an embodiment the conveyor can transport the containers and sleeve arranged around the container into the heat shrink oven. Containers and sleeves are collected on the conveyor, assembled and the sleeve is fixed to the container while being transported through the oven. A continuous high-speed process can be obtained.

In accordance to an embodiment the labelling system further comprises a sleeve support for positioning one or more sleeves in a predetermined position with respect to the one or more containers. The support allows orienting and positioning the sleeve with respect to the container, e.g. halfway the container or acute. The support can be an auxiliary device to help positioning the sleeve with respect to the container.

In the application the predetermined position is a position that allows fixing the sleeve at a desired position around the container.

In an embodiment the conveyor is arranged to direct a downward end of the container towards the ejection unit, when the container passes by the ejection unit.

In an embodiment the ejection unit is arranged to eject upwardly and to eject the sleeve directly around the containers. In a single operational step the sleeve is shot and positioned over the container.

In order to provide a continuous method and to increase the handling speed, the ejection unit is arranged to eject the sleeve around the container while the container is being conveyed by the conveyor.

In an embodiment the conveyor is arranged to transport a row of containers. Containers will be transported at high speed passing the point from which sleeves are shot upwardly over a bottom part of the containers.

Preferably the conveyor is arranged to transport at least two adjacent rows of containers. In an embodiment at least two sleeve supplies, each comprising a mandrel and an ejection unit directed at the conveyor, are arranged to upwardly arrange a sleeve around the containers. This will allow e.g. handling of products comprising 2×2, 2×3 containers at high speeds.

In an embodiment the conveyor comprises an engaging element for engaging a top side of the containers. This will allow arranging the sleeve over a bottom side of the container.

In an embodiment the system further comprises an ejected sleeve support. As ejected sleeve is shot upwardly, the gravitational force will exert a force in the opposite direction that could move the sleeve in the opposite direction, removing the sleeve from around the container. The ejected sleeve support can prevent the removal of the sleeve. The ejected sleeve support supports the sleeve arranged around the container.

In an embodiment the ejected sleeve support comprises a passive plate. The plate can extend along at least a part of the conveyor. The plate can be arranged to support a part of the circumferential edge of the sleeve arranged around the container. The plate can be positioned under the conveyor, specifically under the desired position of the sleeve to support the sleeve upwardly against the gravitational force.

In an embodiment the ejected sleeve support comprises a belt arranged to move along with the conveyor. The belt can move at a higher speed than the conveyor. A skewed sleeve as a result of the acceleration of the sleeve in a horizontal direction after being ejected around the container, can be corrected.

In an embodiment the belt comprises a first belt including a first belt part and a second belt part. The belt parts may be arranged for consecutively supporting a sleeve on the first belt part and second belt part. The first belt part may extend obliquely while the second belt part extends horizontally. In order to allow the horizontal speed component of the first belt part to be essentially the same as the speed of the containers, the transport speed of the first belt part (and the second belt part) should be higher than the conveyor speed. Next to the (dry) first belt a second belt may be arranged, for instance a wet belt configured for transporting the sleeved containers through the oven. The second belt extends in a generally horizontal direction. The speed of the second belt may be essentially identical to the conveyor speed. In embodiments of the invention the transport speed of the first belt is therefore higher than the transport speed of the second belt.

While in the above embodiments the horizontal and oblique belt parts are formed by one single belt, these belt parts may be formed by a plurality of separate belts in other embodiments.

The first belt may be configured to move an ejected sleeve to a forwardly tilted oblique position for creating space between the sleeved container and a subsequent container. This enables the processing process of the system to be increased, especially is cases wherein the distance between consecutive containers suspended from the conveyor is relatively short.

In an embodiment the ejected sleeve support extends into the heat shrink oven. This will allow to continue support of the sleeve up until heat shrinking and fixing of the sleeve to the container starts.

In a further embodiment the container supply is arranged for supplying packaging containers such as cups or the like formed by deep drawing or thermal forming. In an embodiment the container supply comprises a form fill seal machine for forming cups and bottles. in a clocked manner on a packaging interior strip at least one longitudinal row. In an embodiment the container supply comprises a form fill seal machine for forming cups and bottles. Preferably several adjacent rows are formed. In an embodiment the containers are formed according to a predetermined pattern of e.g. 2×2 or 2×3 containers in a single packaging material strip. Preferably the containers are filled with product. Preferably the containers are sealed. The method and system according to the invention allow handling of filled containers in an upright position, thereby preventing disturbance of the product held in the container.

In a further embodiment the container forming the receiving surface for the label is conically shaped. Such conical shapes are hard to label as during heat shrinking a label will tend to move towards the conical tip of the product. Using the support according to the invention, the label is held in a predetermined position during heat shrinking. This will prevent the tendency of the label to move from its desired height position and will reduce the pull down risk and may also enable the application of the sleeving method to containers having difficult shapes.

It will be clear to the skilled person that the drawing shows only preferred embodiments, and that other embodiments fall within the scope of the invention. Although the drawing will show preferred embodiments, and the invention was described with the appended claims, it will be clear to the skilled person that the invention can encompass other features mentioned explicitly in this description, but also implicit features. It will be clear to the skilled person that any of these explicit or implicit features can be combined with features mentioned in this description or in the claims. Divisional applications directed at these features are possible.

Figure 2:
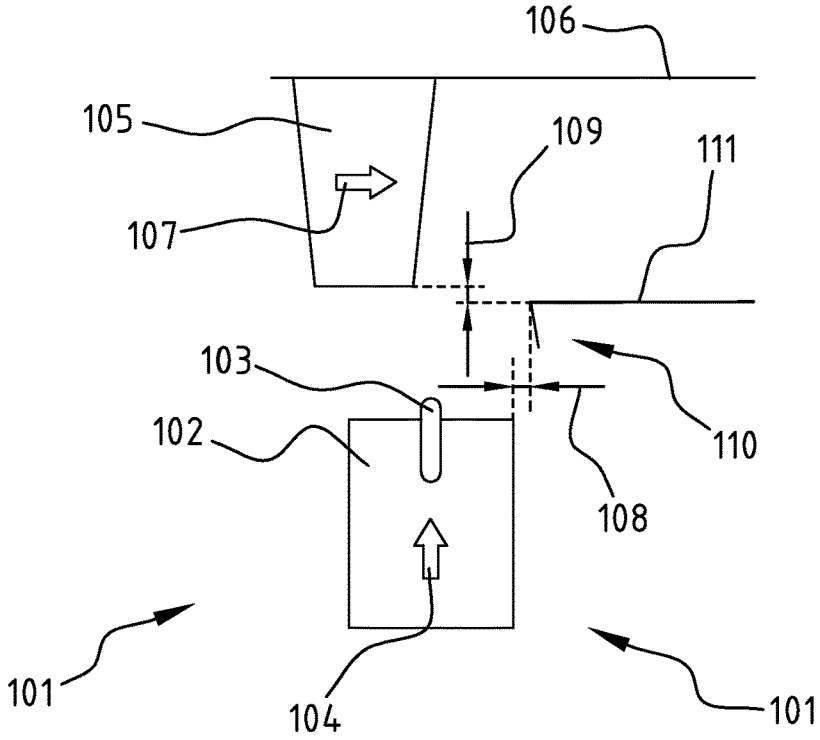
Figure 3A:
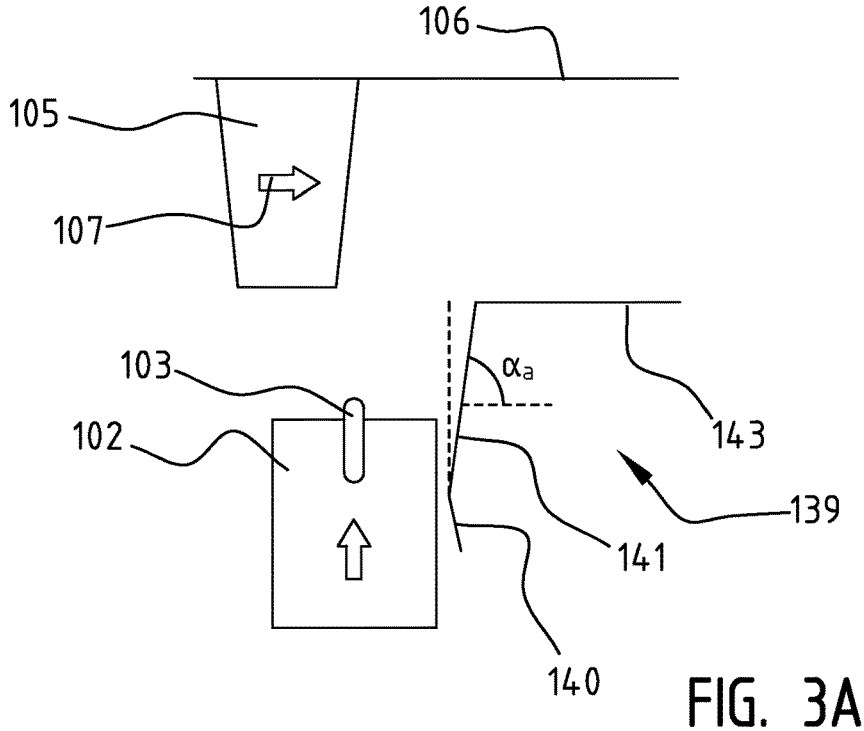
Figure 3B:
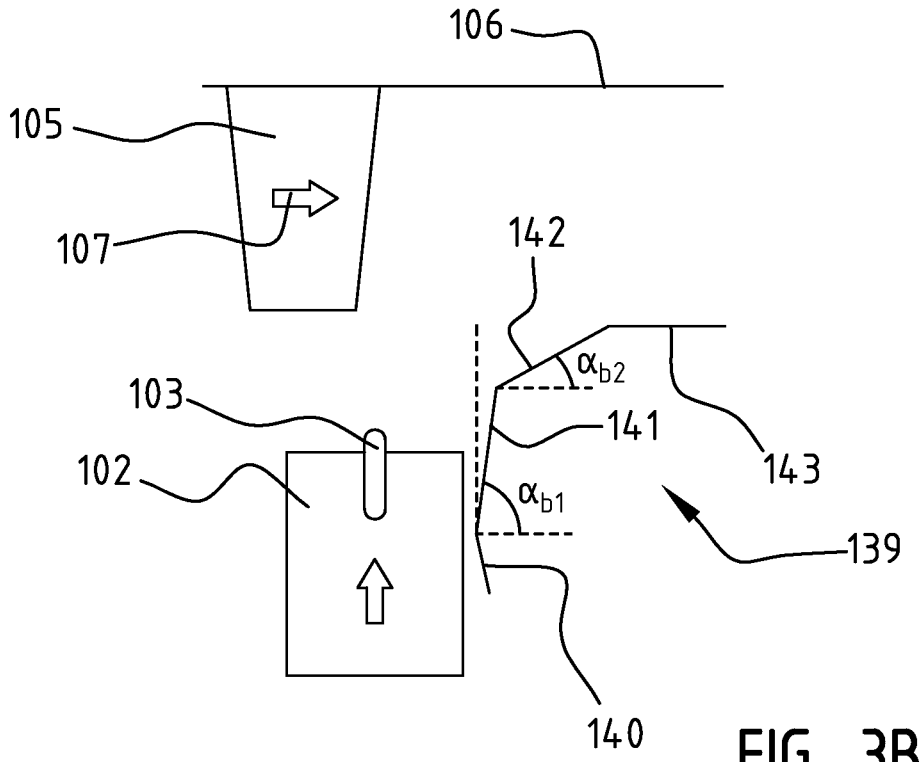
Figure 4A:
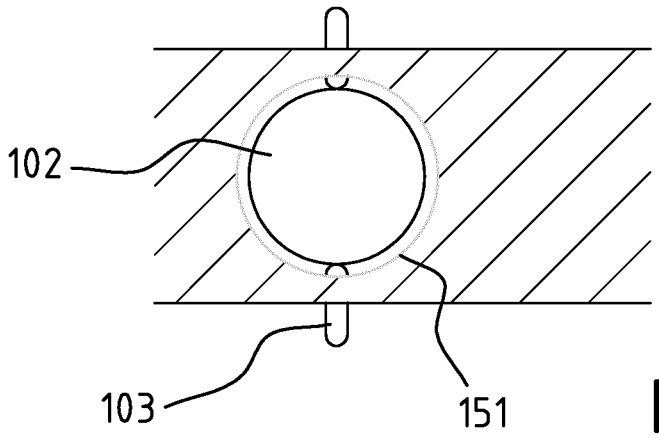
Figure 4B:
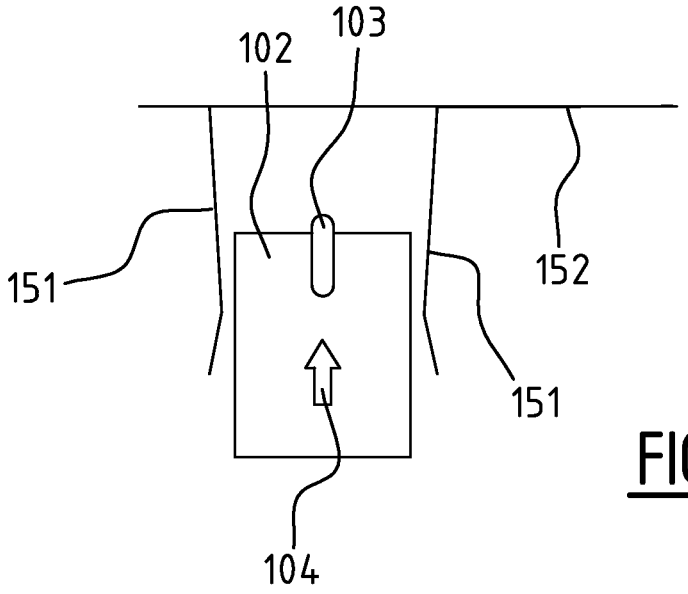
Figure 5:
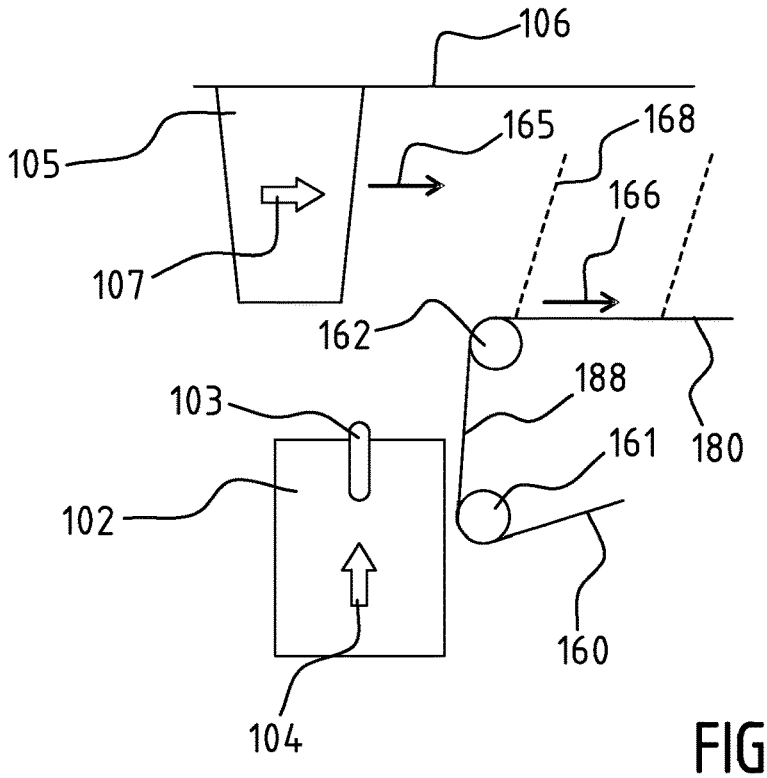
Figure 6:
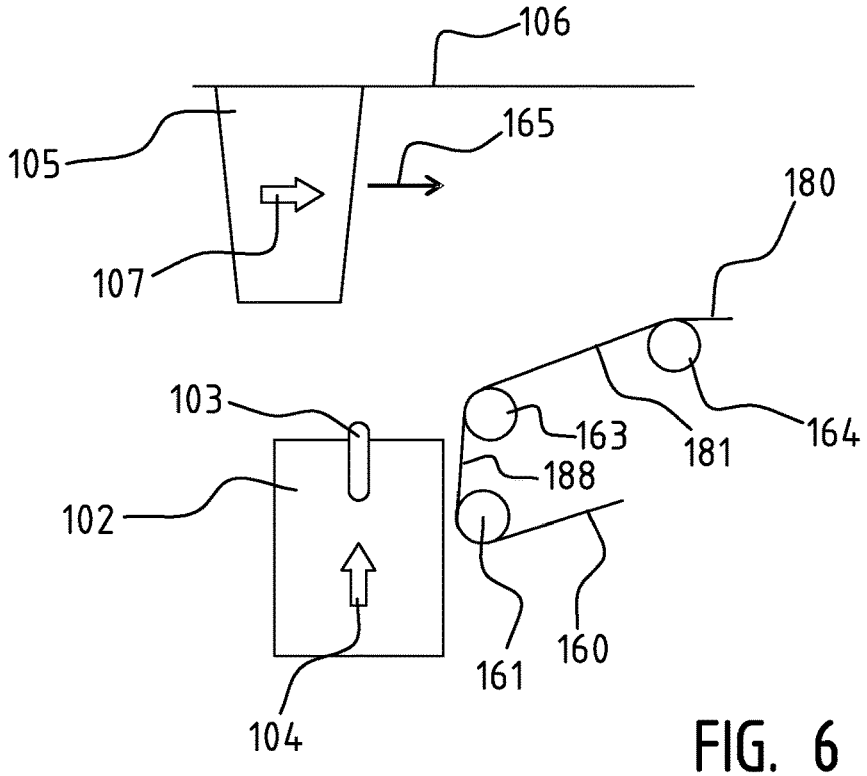
Figure 8:
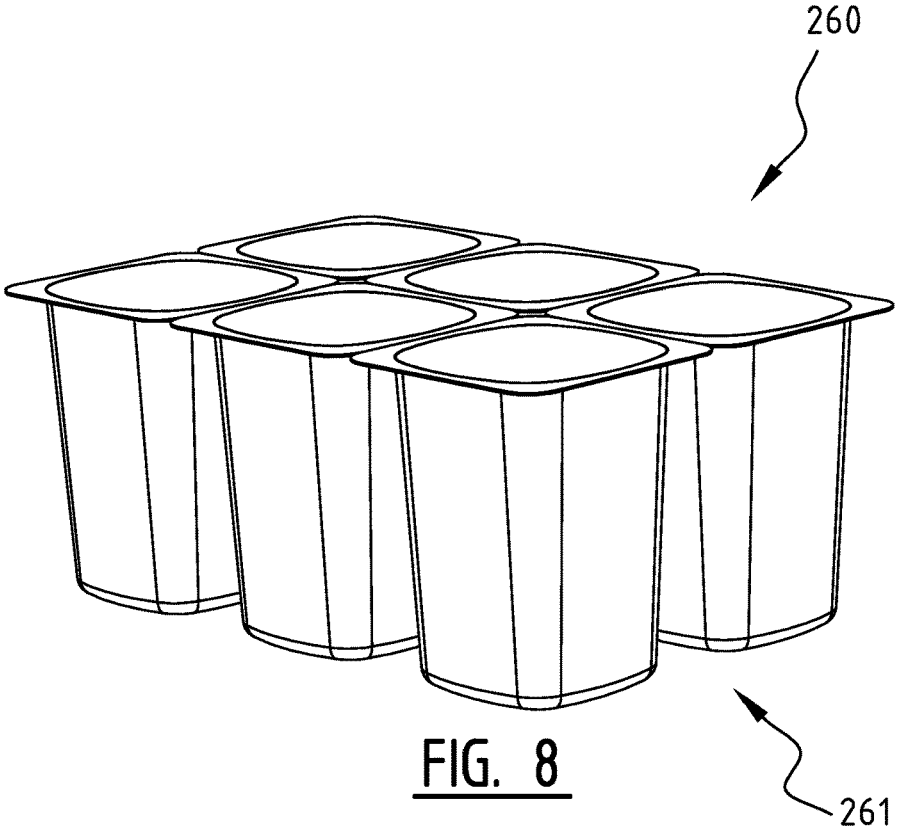
Figure 9A:
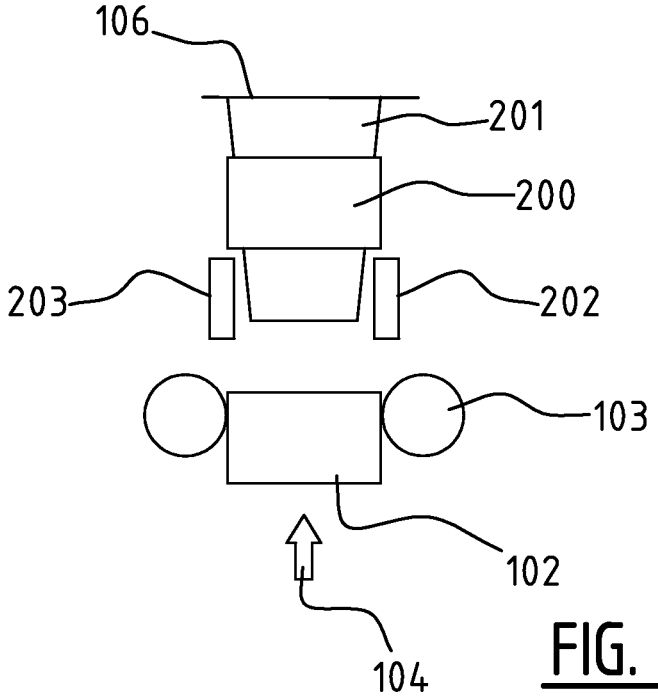
Figure 9B:
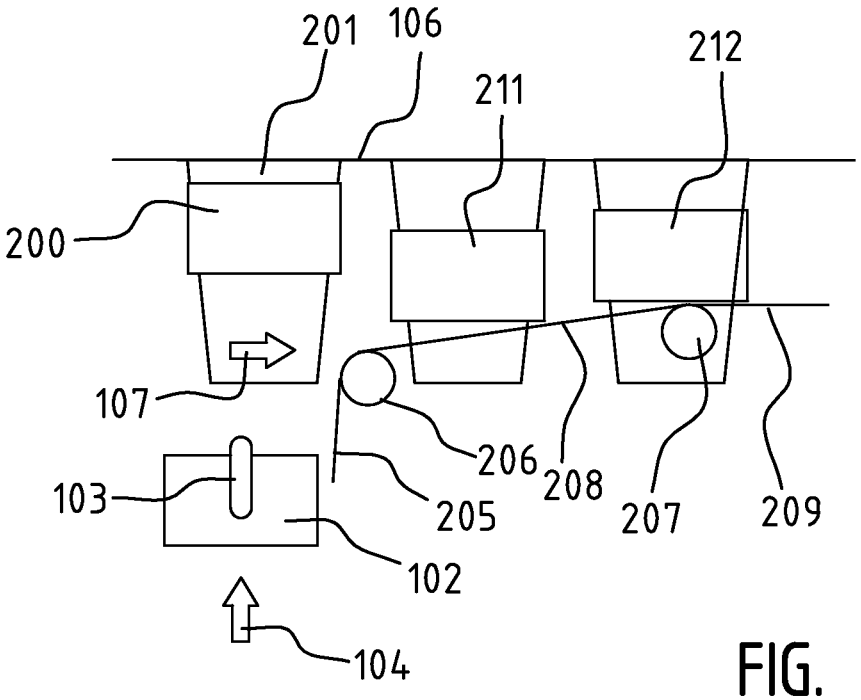
Figure 10:
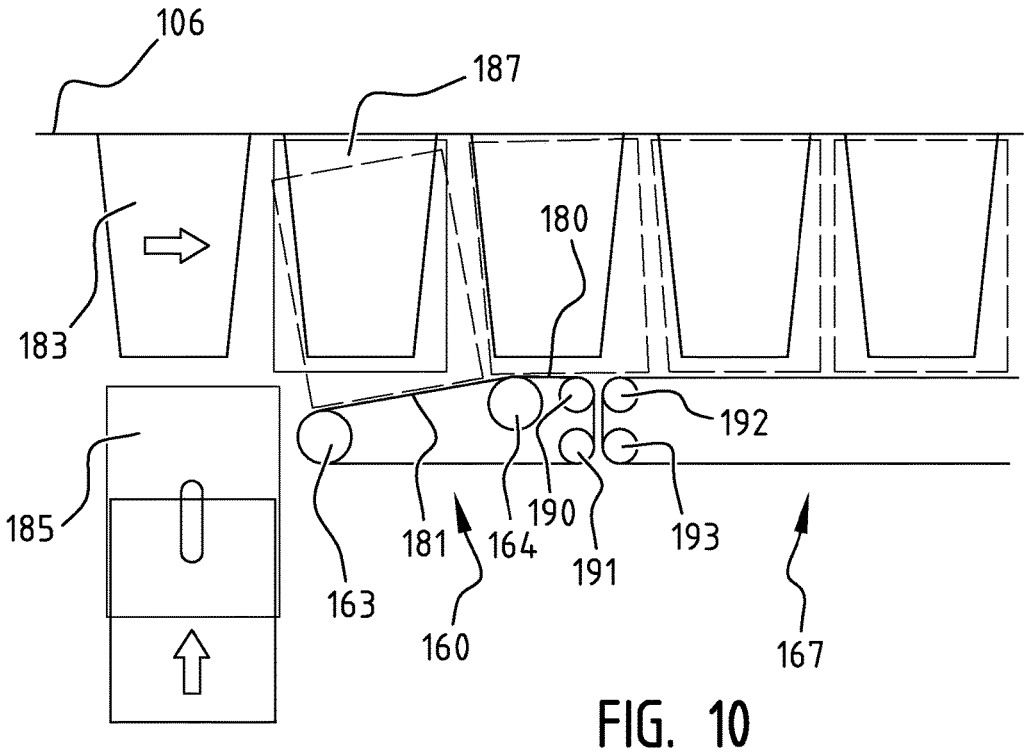

Embodiments will now be described referring to the drawing, wherein:

FIG. 1 shows a schematic overview (front view) of an embodiment of a system and method for sleeving a product, FIG. 2 shows a front view of a first embodiment of a detail according II in FIG. 1, FIGS. 3A and 3B show front views of a second and third embodiment of a detail according II in FIG. 1, FIGS. 4*a* and 4*b* show a top view and front view respectively of a fourth embodiment of a detail according II in FIG. 1, FIG. 5 shows a front view of a further embodiment of a detail according II in FIG. 1, FIG. 6 is a front view of a further embodiment of a detail according to II in FIG. 1, FIGS. 7A,7B and 7*c* are schematic representations of further embodiments of the present invention;

FIG. 8 shows a perspective view of a thermoformed product having 2×3 containers;

FIGS. 9*a* and 9*b* show respectively a side view and front view of a further embodiment of a detail according II in FIG. 1;

FIG. 10 a schematic representation of a further embodiment of the present invention.

FIG. 1 shows schematically a sleeving system 1 for sleeving and labelling containers. The illustration is a front view. A foil reel 500 is provided in a foil stock 501. Foil is supplied in step S1. In an embodiment a splicer is used in step S1 to connect subsequent foils from rolls to provide a continuous feed of foil.

The reel 500 provides a heat shrinkable foil 502. The foil 502 is tubular. The reel provides the tubular foil in flattened form. In an embodiment the invention is limited to one or more properties of the foil.

The foil is fed to a buffer 503. Buffer 503 allows buffering S2 of foil e.g. when a reel 500 is replaced, to provide a continuous feed 505 to the downstream applications such as the illustrated stationary mandrel unit 506 comprising a mandrel 507 and ejection unit 508.

As the flattened tubular foil is guided along the mandrel 507 the foil is opened S3 by the tip 515 of the mandrel 507. The mandrel unit 506 further comprises a cutting unit 514 for cutting of sleeves S4 from the supplied opened foil. The ejection unit 508 may comprise a number of wheels or rolls configured to impart on the sleeves an acceleration so that they are ejected in the direction of a container positioned above the mandrel.

In this embodiment containers 511 have a generally tapering shape, i.e. near a top end the container essentially has a larger cross-section than at bottom end of the container. The container may have a frusto-conical shape as is shown in the figures. However, the system and method according to the present invention may also be applied to differently shaped containers or cups. Furthermore, the containers (also referred to as "cups") may be transported one by one, for instance in one or more rows of containers. In other embodiments the containers may be combined into a number of products, each product comprising more than one container or cup.

Furthermore, according to embodiments of the invention, the containers should be kept in an upright position wherein relatively wide top end of the container extends above the relatively small bottom end of the container, for instance in case of thermoformed plastic containers or cups for storing food or a similar content. These containers or cups should not be rotated upside down and should maintained the upright position throughout the entire sleeving process.

Referring to FIG. 1, a container 511 can have an opening near a top side, while the bottom side is the smaller end of the container. In some embodiments the containers 511 have a rim (not shown in FIG. 1). The containers can be filled with content, such as food.

The top end of the container 511 is engaged by conveyor 512, for instance a vacuum conveyor, leaving the bottom end 520 of the container 'hanging free'. Embodiments of the conveyor may comprise wires supporting a top rim of the container to allow the illustrated support.

Ejection unit 508 in the shown embodiment comprises two rotatable wheels for physically engaging the cut sleeve, accelerating the sleeve and ejecting the sleeve S5 from the mandrel over the container 511. A suitable controller is arranged to operate the units and to synchronize the ejecting with the movement of the containers. More specifically, a suitable controller is arranged to synchronise the ejection, container supply, cutting and other method steps.

In embodiments of the invention the containers are aligned with the ejection unit 508 at the moment of ejection of a sleeve. However, in other embodiments a container is not aligned as will be discussed hereafter.

Containers 511 are continuously (i.e. non-intermittently) conveyed by conveyor 512 in direction 516, in this embodiment also during the actual shooting upward 521 of the sleeve over the container 511. Since the containers 511 are supplied in a continuous manner they constitute a row of containers. Although not shown in the appended figures, clearly several rows of containers can be supplied adjacently. In particular this allows supplying of products comprising several containers, such as yoghurt containers. Yoghurt containers can be thermoformed from a plate, wherein 2×2, 2×3 or 2×4 containers are formed in a single plate. The two rows of containers are fed adjacently to two mandrels 507 positioned adjacently. The sleeves are shot over the containers.

The foil 502 and the resulting sleeves 510 are cut and shot in an upward direction over containers 509. The sleeve 510 and container 511 assembly is conveyed S6 further in direction 516 by conveyor 512.

As the sleeve 510 is arranged around container 511, sleeve 510 will be arranged around the tapered surface of the container. Container 511 is still transported in direction 516. Sleeve 510 is subsequently accelerated in direction 516. Almost instantaneously the lower edge 522 of sleeve 510 will be supported by an sleeve support 517, here schematically illustrated as a passive plate 517. The plate 517 will support the edge 522 and subsequently the complete bottom side of the sleeve. This will guide the sleeve towards a desired position with respect to the container and subsequently hold the sleeve in the desired position.

Plate 517 may be dimensioned to have a larger width than the sleeve enabling the plate to fully support the sleeve. In other embodiments the plate having a smaller width may be sufficient to support the sleeves.

Conveyor 512 transports the sleeved containers further downstream e.g. into a heated steam oven 513. Foil 502 is a heat shrink foil. The steam will heat shrink S7 the sleeve and the sleeve is attached to the container, providing a labelled container 518. In a subsequent step a drying process can be applied.

As schematically illustrated, the ejected sleeve support 517 extends into the heat oven 513, supporting the sleeve in the desired position, up until the sleeve is fixed.

Advantages of a system set up according to FIG. 1 are high speed, accuracy, reliability and reduced space. Not only sleeves are provided at high speed using the ejection unit 508, but also the heat shrinking in the oven 513 is executed quickly, limiting the actual heating of the container 511 that could already contain the product such as a dairy product. The illustrated system also allows handling of thin foils of less than 60 μm.

The system according to FIG. 1 allows sleeving of containers and labelling of containers.

Although it will be clear that the ejected sleeve support is an auxiliary support, not needed for the invention, in some embodiments of the invention, this ejected sleeve support is beneficial, for instance for sleeves which are positioned without underlap.

In embodiments without the ejected sleeve support, the sleeve is arranged to engage the container after being ejected. The size of the sleeve can be adjusted to the size of the container. In case of a container having a tapered shape wherein the bottom end has a smaller cross section than the upper end the circumference of the sleeve is sufficiently large to be moved over the bottom end of the container and sufficiently small to lock itself when it is moving further upward. The dimensions of the sleeve therefore are selected to be somewhat smaller than the circumference of the container at a certain height above the bottom of the tapered container. In another embodiment glue could be to (temporarily) stick the sleeve to the container.

FIG. 2 shows a detail at position II in FIG. 1. The mandrel unit 101 comprises a stationary mandrel 102. A tubular foil is caused to move upwardly along the mandrel 102 and is cut by cutting means (not shown) to provide a sleeve of suitable dimensions. The mandrel unit 101 further comprises a number of ejectors 103 (for instance rotating wheels) for accelerating the sleeve and shooting the same sleeve upwardly causing the sleeve to be ejected from the mandrel unit 101. A sleeve released from the mandrel 102 and ejected from the mandrel unit 101 travels against the gravitational force in the direction of a container 105 suspended above the mandrel unit 101 from the conveyor 106 moving the container in direction 107 and is slid over tapered end of the container 105.

As the sleeve is ejected upwardly from the mandrel 102, container 105 is moved above the mandrel. Container 105 will drag (move) the sleeve in direction 107. The sleeves may have the tendency to move downward under the influence of gravity after they have been shot upwardly and been arranged around the containers. In order to avoid the situation wherein the sleeves fall off of the containers before they have been attached to the container, for instance before a sleeve has undergone a heating treatment, the sleeves should be supported.

In embodiments of the invention such support is provided by a plate, for instance plate 517 shown in FIG. 1 or plate 111 shown in FIG. 2. The plate is arranged at a suitable height below the conveyor 106. A guidance tip, for instance guidance tip 523 (cf. FIG. 1) can be formed at the upstream end of plate 517 to allow a proper guidance of the sleeve along the plate. Plate 111 is positioned at a distance 108 downstream from the upstream end of the mandrel 102 as indicated in FIG. 2. The distance 108 may vary depending on the circumstances. The distance allows the sleeve to be shot upwardly and reach the container without interfering with the plate 111.

The distance may be adjusted to allow almost instantaneous support of the sleeve after the sleeve has been slid upward over the container and tends to fall downward again. In some embodiments length 108 can be negative, e.g. the tip of plate 111 is positioned downstream from the upstream end of the mandrel, dependent on the orientation, size, shape and properties of the sleeve.

In the embodiment of FIG. 2 plate 111 is positioned a distance 109 below the bottom end 520 (see FIG. 1) of the container. This causes the bottom end of the sleeve to extend below the bottom end of the container when the container enters the oven 513. This arrangement allows the sleeve to underlap the container. As a bottom edge of the sleeve is supported by the plate 111, this bottom edge extends under the bottom end of the container 105 and during heat shrinking this extending portion will heat shrink covering the bottom part of the container, as shown in FIG. 1. For instance, labelled container 518 of FIG. 1 comprises an underlapped sleeve 530. In other embodiments, however, the plate may extend at a higher position, for instance even above the bottom end of the container 520 of the container for supporting partial labels. An example of this arrangement is shown in FIGS. 9A and 9B.

FIGS. 3A and 3B show other embodiments of an ejected sleeve support. Parts similar to FIG. 2 have the same or similar reference numerals. The ejected sleeve support comprises a plate 139 having an essentially horizontal part 143 and one part (FIG. 3A) or several parts (FIG. 3B) extending obliquely with respect to the horizontal part. The horizontal part 143 supports the bottom edge of the sleeve and holds the sleeve in its desired position around the container. Horizontal part 143 may extend into the heat oven 153.

In the embodiment of FIG. 3A a first oblique part 141 of the ejected sleeve support 139 extends at an angle ($\alpha_a$) relative to the horizontal direction. This part of the sleeve support is placed at an angle to allow the sleeve to follow to some extent the movement of the container when it is transported along the mandrel unit. The oblique orientation of this part of the support allows some tolerance for the sleeve as it is being shot upwardly 104. The further oblique part or lip 140 has a different function similar to that of tip 110 in the embodiment of FIG. 2. The part 140 is provided to avoid jamming of the sleeve during displacement of the foil towards the ejection position (at the upper part of the mandrel) and further.

The part 141 of the ejected sleeve support 139 extends at a suitable angle ($\alpha_a$) relative to the horizontal direction to allow a proper support for the sleeves. The suitable angle depends amongst others on the dimensions and shape of the cups, the velocity of the conveyor, the material of the sleeve, etc.

In the embodiment of FIG. 3B the support 143 comprises a first oblique part 141 and a second oblique part 142, each extending at a different angle ($\alpha_{b1}>\alpha_{b2}$) with respect to the horizontal direction (i.e. a direction parallel to the displacement direction of the containers). In further embodiments the support 139 may comprise more than two oblique parts and/or may be curved to achieve the desired effect.

FIGS. 4*a* and 4*b* show further embodiments for a ejected sleeve support. FIG. 4*a* schematically shows a top view of the ejected sleeve support, while FIG. 4*b* shows a front view, similar to the views in FIGS. 2 and 3. In these embodiments the ejected sleeve support comprises a plate 152 essentially performing a similar function as the plate of FIG. 1. Plate 152 according to the present embodiment extends both upstream and downstream of the mandrel 102. The plate comprises a central opening sized and positioned to allow an ejected sleeve to pass the plate. At the bottom side of the plate 152 a downward extending tubular part 151 is provided. The tubular part 151 partially surrounds the mandrel 102 and may provide guidance for the sleeve after being ejected upwardly toward the container (not shown in FIGS. 4*a*,4*b*).

FIG. 5 shows a further embodiment of an ejected sleeve support. Here the ejected sleeve support comprises a movable belt 160 guided over several rolls 161,162. The movable belt 160 is driven by a suitable driving mechanism (not explicitly shown in the figures). In the example shown the sleeve is oversized relative to the tapered container so that the sleeve may also be attached (for instance by a suitable heat shrinking process) around the lower part of the container or even around the bottom of the container. In the embodiment shown in FIG. 5 the width of the belt 160 is larger than the width of the sleeve in order to provide full support for the sleeve.

Referring to FIG. 5, belt 160 is moving at speed $V_2$ 166. Conveyor 106 moves the containers at speed $V_1$ 165. Belt 160 will provide a similar support as plate 111 according to FIG. 2. Belt 160 preferably moves at a speed ($v_2$) 166 that is higher than conveyor speed ($v_1$) 165. In embodiments of the invention the horizontal speed (velocity) component ($v_{2,x}$) of the speed ($v_2$) of the oblique part 141 of the belt is chosen to be essentially the same as the conveyor speed ($v_1$). In order to achieve this the belt speed (v2) should be higher than the conveyor speed.

Another reason for choosing the belt speed to be higher than the conveyor speed is that a high speed may be used to tilt the containers in a forward direction while being conveyed by the conveyor. As a sleeve is shot upwardly 104 over container 105, it will be accelerated sideways, i.e. in direction 107. This could result in a skewed position of the sleeve as illustrated by the sleeve 168 represented with dotted lines. As the bottom side of the sleeve is engaged by the belt 160 moving at a higher speed, the sleeve may be tilted forward causing the sleeve position to be corrected to the desired vertical direction.

FIG. 5 shows that the ejected sleeve support element may comprise a belt 160 with an essentially horizontal sleeve supporting belt part 180. For similar reasons discussed in connection with the embodiment of FIG. 3A, the belt 160 may also have a part 188 arranged to extend obliquely with respect to the vertical direction.

In the embodiment of FIG. 6 the belt 160 is guided along rolls 161,163,164 and is provided, between the horizontal sleeve supporting belt part 180 and the oblique part 188, with a further oblique sleeve supporting belt part 181. This belt part 181 forms a supporting ramp for the sleeves. After the sleeve has been shot onto the container from below, the sleeve falls down and the ramp formed by the oblique part 181 of the belt will provide support. Because this belt part 181 is at an angle and the belt is running faster than the conveyor, the sleeve is slightly tilted. The tilting may create an opening to provide more space for shooting the next sleeve onto the following container.

Figure 7A:
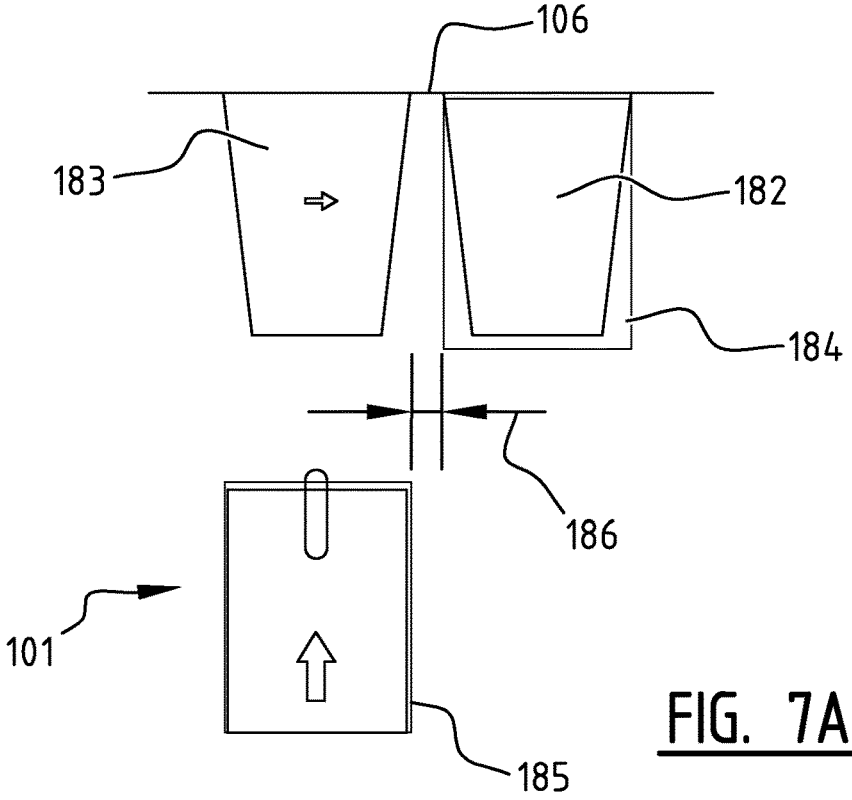
Figure 7B:
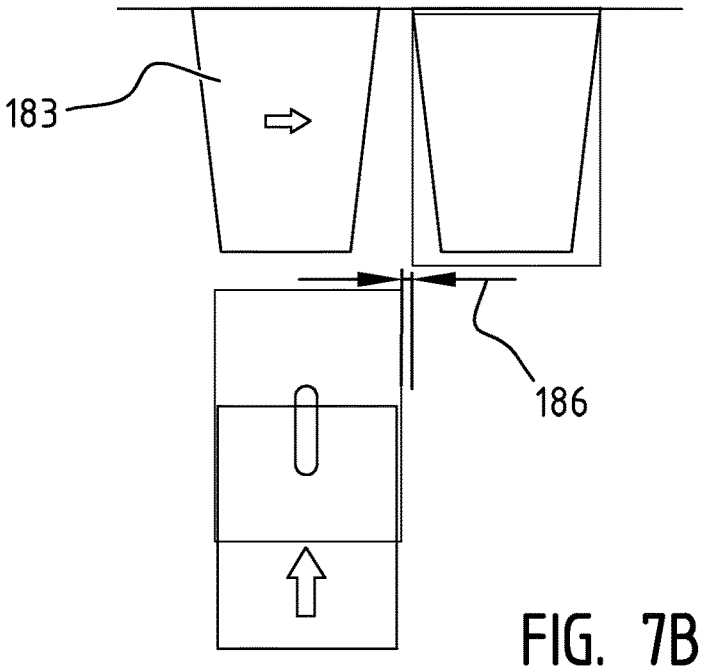
Figure 7C:
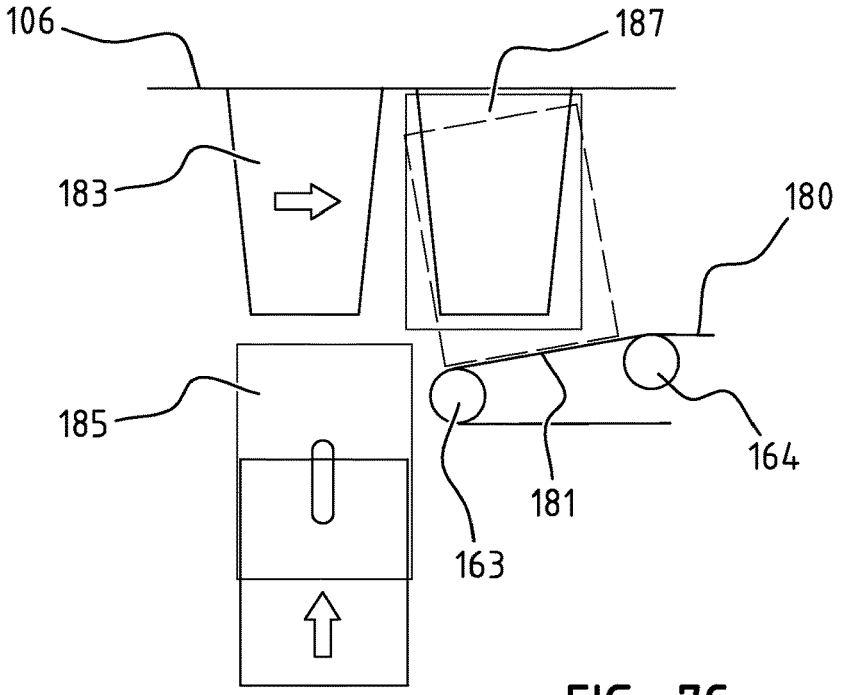

In FIGS. 7A-7C, different operating conditions for the sleeving system are shown. Referring to FIG. 7A, when the conveyor 106 travels at a relatively low speed, the time interval between consecutive containers 182,183 passing the mandrel is sufficiently long to allow a sleeve to be shot and arranged around container when the container has fully passed the mandrel 102 of the mandrel unit.

Referring to FIG. 7B, when the conveyor speed increases and/or when the distance between consecutive containers is reduced (for instance when a plurality of containers is part of one product, as is shown in FIG. 8), the controller should control the system to shoot the sleeve at an earlier moment to allow the sleeve to timely reach the container, i.e. before a further container arrives. In the situation depicted in FIG. 7B the sleeve is already been partly released from the mandrel unit when the next container arrives.

Although the first container has passed the mandrel already, the available space (see distance 186) is minimal. If the conveyor speed would be increased further, the sleeve for the second container will be blocked or its arrangement on the container would at least be hampered (FIG. 7C). This may cause jamming of the system. To avoid this situation the sleeve or the sleeve in combination with the container is moved to the position indicated in FIG. 7*c* by the dotted lines.

FIG. 10 shows a further embodiment of the present invention. This embodiment corresponds to the embodiments described in connection with FIG. 7C except that the device comprises a first belt 160 and a separate second belt 167. The first belt is guided along rolls 163,164,190,191 and comprises a first belt part 181 extending obliquely with respect to the conveyor transport direction and a second belt part 180 extending parallel to the conveyor transport direction (i.e. in this case the second belt part extends horizontally). The second belt 167 is guided along a number of rolls, tow rolls 192,193 of which are shown in the figure. The second belt 167 extends parallel to the conveyor transport direction (i.e. horizontally) as well. The speed of the first belt 160 is selected to be higher than the speed conveyor 106 and the speed of the second belt 167 is selected to be the same or about the same as the conveyor speed. The second belt 167 is configured to transport the sleeved containers to a position halfway the heated steam oven 513. In this position the sleeves may be shrunk around the containers.

According to further embodiments of the present invention the sleeve and possibly also the container, are tilted. Because of the presence of the oblique belt part 181 and/or the relatively high speed of the belt, the sleeve may be tilted to an extent that the sleeve, and possibly also the associated container, provides sufficient space to allow a subsequent sleeve to be shot on a subsequent container. This embodiment enables a further increase of the conveyor speed and thereby an increase of the sleeving capacity of the sleeving system.

In the embodiment shown in FIGS. 5, 6 and 7 the lower part of the sleeve may be supported by an ejected sleeve support element (e.g. a belt or a plate) extending beneath the bottom part of the container. In other embodiments, for instance in the embodiments of FIGS. 9A and 9B wherein partial sleeves are provided, the sleeve is to be attached at a higher position. In these embodiments two or more ejected sleeve support elements are needed to properly support the sleeve.

FIGS. 9A and 9B schematically show an ejected sleeve support in a side view and front view, respectively. Sleeve 200 is ejected by ejectors 103 of the ejection unit from mandrel 102 of the mandrel unit in the upward direction 104 to be arranged over container 201. Ejected sleeve support elements 202, 203 of the ejected sleeve support are positioned on opposite sides along the transport path of the containers 201 conveyed by conveyor 106 in direction 107.

In this example the sleeves are to be positioned generally halfway the container. Here a belt 205 guided over rolls 206,207 provides guidance to the sleeve 200.

Directly after ejection the sleeve 200 is arranged over the container 201. As a result of the gravitational force the sleeve is allowed to 'fall back' downwardly. The falling sleeve 211 is caught by the belt 205. The belt part 208 extending between rolls 206,207 will support the sleeve and guide the sleeve upwardly. Belt part 209 supports the sleeve 212 in its desired position, somewhat halfway the container. The sleeve is subsequently shrunk at the desired position.

The container product 511,201 is in a preferred embodiment of the invention a thermo-formed product formed from a plastic sheet, e.g. using deep drawing. Thermoforming can be part of the sleeving/labelling plant according to the invention, in particular part of the container supply. FIG. 8 shows a perspective view of a thermoformed product suitable to container yoghurt. 2×3 containers 261 are part of the product 260.

Although the exemplary embodiments show exclusively conical containers, clearly the invention is not limited to such containers. Other shapes, forms, sizes of containers can be used in combination with the invention.

Within the scope of this invention many embodiments are possible. Elements disclosed with respect to any of the embodiment mentioned above can be combined or replaced elements from other embodiments.

The invention claimed is:

1. Container sleeving method for arranging at least one sleeve around at least one container, the method comprising supplying a container;

arranging a sleeve of heat shrinkable foil around the container by releasing the sleeve from a mandrel unit by ejecting the sleeve towards the container, the ejecting causing the sleeve to travel from an ejector of the mandrel unit to a first position wherein the sleeve is arranged around the container;

wherein the ejected sleeve is moved upwardly in substantially the opposite direction of the gravitational force from the ejector to the first position around the container, and wherein the sleeve travels unsupportedly from a release position, where the sleeve is clear of the mandrel in a vertical direction, toward and until reaching the first position.

2. Method according to claim 1, wherein ejecting the sleeve comprises shooting the sleeve from the mandrel unit towards the container and sliding the sleeve over the container and/or wherein the sleeves are arranged around the container directly from the mandrel unit as a result of the kinetic energy imparted on the sleeve by ejecting the sleeve from the mandrel unit and/or wherein the method comprises imparting on the sleeves an acceleration, so that they are ejected in the direction of a container.

3. Method according to claim 1, wherein the method comprises continuously conveying an array of containers and arranging sleeves over consecutive containers while the containers are being conveyed and/or wherein the mandrel unit is a stationary mandrel unit and/or wherein supplying the containers comprises transporting the containers suspended with an end to be sleeved extending downwardly.

4. Method according to claim 1, wherein the method further comprises supporting an ejected sleeve once it has reached the first position around the container and/or before the sleeve drops off the container due to gravity.

5. Method of claim 4, comprising displacing the sleeve to a predetermined position with respect to the container.

6. Method according to claim 4, wherein supporting the ejected sleeve in the first position around the container comprises moving a belt beneath the sleeve arranged around the container while being conveyed, the belt being arranged so as to tilt the sleeve to a suitable position.

7. Method according to claim 6, wherein the belt is moving at a higher speed than the container being conveyed.

8. Method according to claim 6, comprising having the belt move the ejected sleeve to a forwardly tilted oblique second position, relative to the first position, for creating space between the sleeve and a subsequent container.

9. Method as claimed in claim 1, comprising supporting the sleeve consecutively on a first belt part and a second belt part, the first and second belt part extending obliquely and horizontally, respectively.

10. Method according to claim 9, comprising supporting a sleeve on a first belt and a second belt, the first belt comprising the first belt part and the second belt part, wherein the speed of the first belt is higher than the conveyor speed and/or the speed of the second belt is essentially the same as the conveyor speed, and/or supporting a sleeve on a first belt and a second belt, the first belt comprising the first belt part and the second belt comprising the second belt part, wherein the speed of the first belt is higher than the conveyor speed and/or the speed of the second belt is essentially the same as the conveyor speed, optionally further comprising supporting the container on a third belt after having supported the container on the second belt.

11. Method according to claim 1, wherein ejecting the sleeve from a mandrel unit comprises providing flattened tubular foil, opening the foil over the mandrel and cutting sleeves from the foil and/or comprising transporting the container and sleeve arranged around the container into a heat shrink oven and heat shrinking the sleeve around the container to fix the sleeve to the container.

12. Method according to claim 1, wherein arranging the sleeve comprises:

sliding onto a body of said at least one container a heat-shrinkable label in the form of an annular band; and causing the label to adhere to said container and/or wherein supplying containers comprises deep drawing or thermoforming packaging containers, such as cups or the like, on a packaging material strip having containers in at least one longitudinal row and having a rim and/or wherein supplying the containers comprises supplying thermoformed containers having a tapered surface, for instance a truncated-conical surface, around which the sleeve is to be arranged.

13. A container sleeving system for arranging sleeves around containers comprising:

a conveyor for transporting containers, and a sleeve supply for arranging heat shrinkable sleeves around containers transported by the conveyor, the sleeve supply comprising a mandrel unit and the mandrel unit comprising an ejection unit for ejecting the sleeve from the mandrel unit, the ejection unit being configured to move the sleeve upwardly in substantially the opposite direction of the gravitational force from an ejector of the mandrel unit to a first position around the container, the ejection unit causing the sleeve to travel from the ejector of the mandrel unit to the first position wherein the sleeve is arranged around the container, wherein the sleeve travels unsupportedly from a release position, where the sleeve is clear of the mandrel in a vertical direction, toward and until reaching the first position.

14. System according to claim 13, wherein the mandrel unit is configured to shoot the sleeve from the mandrel unit towards the container causing the sleeve to slide over the container to the first position wherein the sleeve is arranged around the container and/or wherein the ejection unit is configured to arrange the sleeve around the container directly from the mandrel unit as a result of the kinetic energy imparted on the sleeve by the ejection unit and/or wherein the ejection unit comprises two rotatable wheels for physically engaging the cut sleeve, accelerating the sleeve and ejecting the same from the mandrel over the container and/or wherein the ejection unit is arranged to eject the sleeve while the container is being continuously conveyed by the conveyor.

15. System according to claim 13, wherein the mandrel unit is a stationary mandrel unit and/or wherein the conveyor is arranged to transport at least two adjacent rows of containers, wherein at least two sleeve supplies, each comprising a mandrel unit and an ejection unit directed at the conveyor, are arranged to upwardly arrange a sleeve around the containers.

16. System according to claim 13, wherein the system further comprises an ejected sleeve support to support the sleeve arranged around the container.

17. System according to claim 16, wherein the ejected sleeve support comprises a plate extending along at least a part of the conveyor, the plate arranged to support a part of the circumferential edge of the sleeve arranged around the container.

18. System according to claim 16, wherein the ejected sleeve support comprises a belt arranged to move beneath the conveyor.

19. System according to claim 18, wherein the belt comprises a first belt part and a second belt part arranged for consecutively supporting a sleeve on the first belt part and second belt part respectively, the first and second belt part extending obliquely and horizontally with respect to the conveyor, respectively.

20. System as claimed in claim 18, wherein the belt is configured to move an ejected sleeve to a forwardly tilted oblique second position, relative to the first position, for creating space between the sleeve and a subsequent container.

21. System according to claim 13, wherein the sleeve supply is connectable to a supply of flattened tubular heat shrinkable foil, the sleeve supply comprising an opening unit for opening the tubular foil, and a cutting unit for cutting sleeves from the opened tubular foil and/or wherein the system further comprises a heat shrink oven for fixing the sleeve to the container, and wherein the conveyor is arranged to transport the container and the sleeve arranged around the container into the heat shrink oven.

* * * * *